United States Patent [19]

Tucker

[11] Patent Number: 4,519,552

[45] Date of Patent: May 28, 1985

[54] WIRE ROUTING, TENSION-CONTROLLING AND BREAKING MECHANISM

[75] Inventor: John G. Tucker, Lexington, N.C.

[73] Assignee: AT&T Technologies, Inc., New York, N.Y.

[21] Appl. No.: 539,435

[22] Filed: Oct. 6, 1983

[51] Int. Cl.[3] ..... H01F 11/04; H01F 5/02

[52] U.S. Cl. ..... 242/7.17; 242/7.11; 29/605

[58] Field of Search ..... 242/7.09, 7.11, 7.17, 242/7.18, 7.06, 7.05 B; 29/605; 225/98, 105; 140/92.2

[56] References Cited

U.S. PATENT DOCUMENTS

| | | | |
|---|---|---|---|
| 3,314,452 | 4/1967 | Cartwright et al. | 242/7.09 X |
| 3,713,599 | 1/1973 | Smith et al. | 242/7.11 |
| 3,949,945 | 4/1976 | Broomfield | 242/7.03 X |
| 4,320,876 | 3/1982 | Parham, Jr. et al. | 242/7.11 |

*Primary Examiner*—Stuart S. Levy

*Assistant Examiner*—Katherine Jaekel

*Attorney, Agent, or Firm*—W. G. Dossé; S. I. Rosen

[57] ABSTRACT

In a coil-winding machine, an apparatus for routing a wire (10) from a storage pin (12) to a terminal pin (14) of a coil bobbin (16) mounted on a coil-winding arbor (18) includes routing and tension-controlling pins (50, 52, 54) for routing the wire to either a first set of terminal pins (14) in a first row (14B) or to a second set of terminal pins (14) in a second row (14A) and around the first set of terminal pins. An apparatus for reliably breaking the wire at the terminal pins includes a freely-rotatable breaker pin (80 or 84) which deflects the wire to the breaking point. The routing and tension-controlling pin(s) also serve to decouple at least part of the breaking tension from the storage pin. A cutting apparatus (116) shortens the length of wire extending from the coil of wire wrapped around and ultimately ejected from the storage pin, so as to reduce the likelihood of tangling.

13 Claims, 8 Drawing Figures

FIG.-2
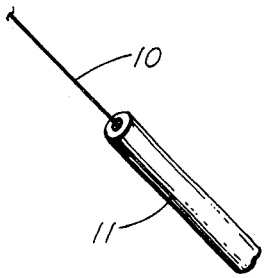
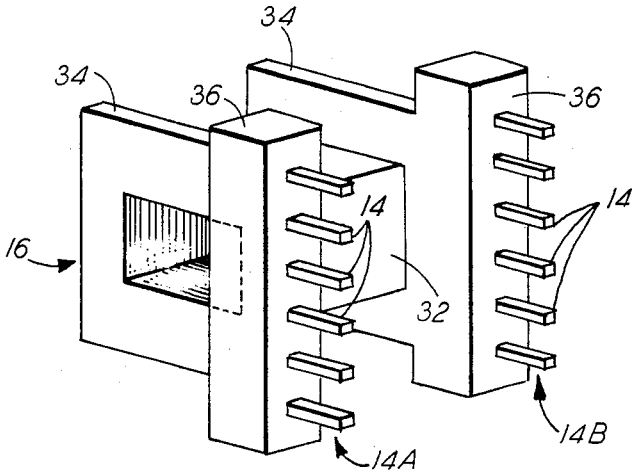
FIG.-3
FIG.-4
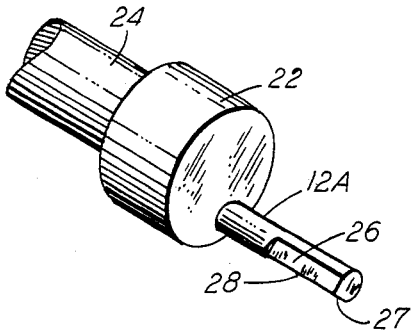

WIRE ROUTING, TENSION-CONTROLLING AND BREAKING MECHANISM

TECHNICAL FIELD

This invention relates to apparatus for routing and controlling the tension in a wire extending from a storage pin to the terminal pins of a coil bobbin and for breaking the wire reliably after the wire has been wound around a terminal pin of the coil bobbin; and more particularly, the invention relates to a mechanism for routing the wire away from one row of terminal pins to another row of terminal pins on the bobbin while so controlling the tension in the wire as to cause the wire to break only at a terminal pin, upon actuation of a wire-breaking mechanism.

BACKGROUND OF THE INVENTION

The D. W. Parham et al. U.S. Pat. No. 4,320,876 granted on Mar. 23, 1982, discloses apparatus for selectively winding a plurality of strands of wire on a bobbin wherein each of the strands of wire travels through a hollow guide needle as the strand of wire is wound on the bobbin. The wire is temporarily wound onto a storage pin in order to avoid losing track of the end of the wire while the bobbin is being mounted onto a winding arbor. The disclosure of the abovementioned Parham et al. patent is incorporated herein by reference as though reproduced in full.

When the bobbin is firmly mounted to the arbor and suitably positioned, the wire guide needle is moved from the storage pin to a terminal pin molded into the bobbin structure. The terminal pin is preferably of square cross-section, having corners that bite into the surface of the wire wrapped around the terminal pin in accordance with the well-known wiring technology known as "wire-wrap". The wire issuing from the guide needle is then wrapped around the terminal pin so as to make good mechanical and electrical contact thereto. Following this, a breaker pin descends on a breaker mechanism and engages the wire stretched between the storage pin and the terminal pin. The wire breaks, preferably at a corner of the terminal pin where the corner has deeply indented the surface of the wire. However, it has been found through experience that the friction that exists between the breaker pin and the wire, as the breaker pin descends, may cause more tension to be applied to the portion of the wire that is stretched between the storage pin and the breaker pin than to the portion of the wire stretched between the breaker pin and the terminal pin. This is due to the angle usually assumed by the wire as it extends down from the storage pin to the terminal pin. The downward movement of the breaker pin thus tends to draw the wire frictionally from the storage pin toward the terminal pin.

The wire is then wound about the bobbin by rotating the arbor at a rapid rate while moving the wire guide needle in the axial direction of the arbor along the length of the coil bobbin so as to lay the wire evenly in precise layers on the bobbin. When the proper number of turns of wire has been wound onto the bobbin, the guide needle is moved to the proximity of another of the terminal pins; and wire is wrapped about that terminal pin by orbiting the wire guide needle. From this point, the wire guide needle moves toward the storage pin.

While the wire is being wound onto the bobbin, the coil of wire that was wound on the storage pin along with the length of wire that extends from the storage pin to the broken wire end is stripped from the storage pin and blown to a scrap bin by a blast of air. Therefore, the storage pin is again empty. The guide needle wraps the wire around the storage pin in order to retain control of the end of the wire after winding. The breaker pin again descends to break the wire, preferably at the terminal pin.

As further disclosed in the above-mentioned Parham et al. patent, the terminal pins on the bobbin are located at only one axial position along the arbor. It is undesirable, when winding wire on bobbins having terminal pins at two axial positions along the arbor axis, to pass the wire and the wire guiding needle through one set of terminal pins to reach another set of terminal pins. Besides, passing the wire over one set of terminal pins to reach the far set of terminal pins could cause undesirable breaking of the wire.

SUMMARY OF THE INVENTION

In accordance with one aspect of the present invention, an apparatus routes and controls the tension in a wire that is secured at a point while leading portions of the wire are dispensed and lead toward and to a position adjacent to a terminal pin on a bobbin. A first intermediate portion of the wire is dispensed and routed generally toward the terminal pin, and a portion of a tensile stress in one portion of the wire is decoupled from another portion of the wire. A second intermediate portion of the wire is dispensed and routed directly toward the terminal pin, and another portion of a tensile stress in the one portion of the wire is decoupled from the other portion of the wire.

In another aspect of the present invention, a breaker pin is arranged to engage a length of wire stretching between the storage pin and the terminal pin for breaking the wire, preferably at the terminal pin. The breaker pin is freely rotatable with respect to its support structure so as to minimize the frictional application of unequal tensile forces in the wire on either side of the breaker pin.

BRIEF DESCRIPTION OF THE DRAWINGS

FIG. 2 is a partial, perspective view of a wire issuing from the end of a tubular wire-guiding and dispensing needle which moves in a path shown in FIG. 1, causing the wire to assume a configuration also shown in FIG. 1;

FIG. 3 is a perspective view of a bobbin having terminal pins, the bobbin being shown in FIG. 1 mounted on a winding arbor;

FIG. 4 is a perspective view of a storage pin showing how the pin is cut away to form a 90° knife edge for gripping wire wound therearound;

DETAILED DESCRIPTION

Figure 1:
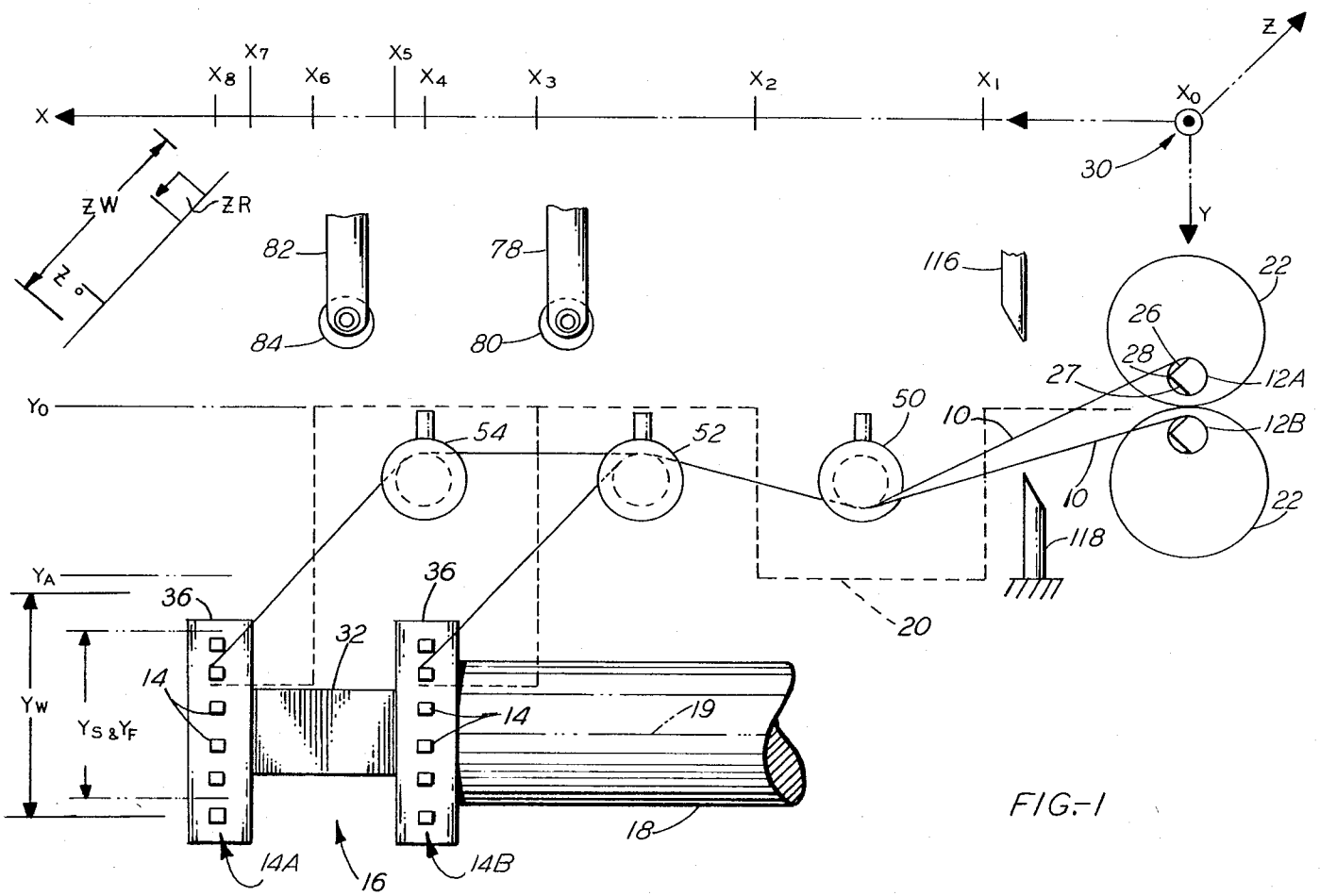
FIG. 1 is a schematic diagram of a winding arbor and bobbin showing storage pins, routing pins, and breaker pins in accordance with one aspect of the present invention.

Referring now to the accompanying drawings and more particularly, FIGS. 1, 2, and 3 thereof, FIG. 1 shows an improved mechanism for guiding wire 10 (FIG. 2) that issues from or is dispensed from a hollow, tubular wire guide or needle 11. Two such needles 11 move about to route the wire 10 from a storage pin 12A or 12B (FIG. 1) to one of a plurality of terminal pins 14 of a bobbin 16 (FIGS. 1 & 3) that is mounted on a winding arbor 18 (FIG. 1).

Small-gauge magnet wire having a varnish-like coating of insulating material is supplied on large reels (not shown). The wire 10 is threaded through the guide needles 11, such as that shown in FIG. 2 and as shown in the above-mentioned Parham et al. patent. The needles 11 are moved in three orthogonal directions (X, Y, & Z) by three stepping motors and their associated mechanism, not shown herein but disclosed in the above-mentioned Parham et al. patent.

The needles 11 are not shown in the schematic diagram of FIG. 1. However, if shown in FIG. 1, the needles 11 would have their longitudinal axes oriented perpendicular to the plane of FIG. 1.

A cycle of operation of the mechanism schematically illustrated in FIG. 1 starts with two needles 11 positioned above the two storage pins 12A and 12B. From the last portion of the prior cycle of operation of the coil-winding machine, the wires 10 that extend through the hollow centers of the needles 11 are wound about the storage pins 12A and 12B. Therefore, when the two hollow needles 11 move away from their starting positions above the storage pins 12A and 12B, two lengths of wire 10 pay out or can be said to be dispensed from their associated reels (not shown) and through their associated needles 11 (FIG. 2), to assume configurations extending from the two storage pins 12A and 12B to the instantaneous positions of the wire-dispensing ends of the two needles 11.

The two needles 11 are preferrably moved simultaneously in essentially the same path (designated by the reference number 20 in FIG. 1) from the storage pins 12A and 12B to two terminal pins 14 of the bobbin 16. The two needles 11 move in fixed mutual, spacial interrelation from the storage pins 12A and 12B to two terminal pins 14 that are spaced apart by approximately the same distance as are the storage pins 12A and 12B. This distance separating the storage pins 12A and 12B is a multiple of the distance between adjacent terminal pins 14. That multiple can be one.

Since the two needles 11 move together in the operation of the preferred embodiment of the present invention, the movement of only one needle will be described unless a second needle is specifically mentioned.

Referring now to FIG. 4, there is shown in perspective, the storage pin 12A, one of the two storage pins 12A and 12B shown in FIG. 1. The storage pin 12A is mounted in an enlarged head 22 of a post 24 that is fixedly mounted on the structure of the coil-winding machine (not shown). There are two flat cuts made on the side of the storage pin 12A to make two flat surfaces 26 and 27 that are 90° apart. These flat surfaces 26 and 27 form a sharp corner 28 that bites into the surface of the wire 10 when the wire is wrapped around the storage pin 12A, in order to hold the wire in place until the wire is intentionally ejected.

Since the description of the movement of one needle 11 is sufficient to describe the movement of the other needle, there is little need to make frequent reference to both storage pins 12A and 12B. Therefore, the storage pin that is associated with the described needle 11 will be designated by the reference number 12 and could be either storage pin 12A or 12B. If some distinction is to be made between the two storage pins, the reference number designations 12A and 12B will be used.

In prior coil winding machines such as that disclosed in the above-mentioned Parham et al. patent, the needle 11 would simply follow the shortest possible path directly from the storage pin 12 to the desired terminal pin 14. However, as illustrated by the path 20 in FIG. 1, according to the present invention, the needle 11 moves in a more devious path.

Referring again to FIG. 1, and more particularly to a three-axis coordinate system 30, the hollow guide or needle 11 (FIG. 2) is positioned above the storage pin 12 as a reference position. This is the initial position of the needle 11, and in the X, Y, Z coordinate system 30, is referred to as position (Xo, Yo, Zo). This initial position (Xo, Yo, Zo) of the needle 11 is at the right-hand end of the dotted line that represents the path 20. To preserve clarity, that initial position of the needle 11 is not specifically indicated in FIG. 1.

As illustrated in FIGS. 1 and 3, the bobbin 16 is conventional in nature and includes a square central tube 32 onto which the wire 10 is wound. The tube 32 ends in two flanges 34 (FIG. 3) which support the ends of the coil of wire 10 (not shown in FIG. 3) wound on the bobbin 16. Each flange 34 has a single bulky edge 36 into which six terminal pins 14 of square cross-section are molded in a row 14A or 14B.

In the operation of the mechanism in FIG. 1, a framework (not shown) that holds the needle 11 is driven in the X, Y, and Z directions of the axis system 30 by three stepping motors (not shown), each of which drives the needle in one of the three mutually-orthogonal directions. At the start of a cycle of operation of the machine, the X motor is operated to move the needle 11 to the left in the X direction from its initial position over the storage pin 12, as indicated in FIG. 1 by the dotted line or path 20.

A representation of the X-axis, as shown in the axis system 30, across the top of FIG. 1, comprises a scale indicating several significant "X" positions that the needle 11 can assume as it moves along the dotted line or path 20. A "Y" scale of needle positions is noted along the left side of FIG. 1 to indicate some of the "Y" positions assumable by the needle 11. These "X" and "Y" positions, along with "Z" positions (not shown) along the Z-axis, perpendicular to the plane of FIG. 1, are described in detail below.

It has been found experimentally that, in the mechanism illustrated in FIG. 1, wire of 40-gauge or smaller diameter should follow a more labyrinthine path than wire of larger than 40-gauge. Consequently, the initial movement of the needle 11 to the left in the X direction can be either quite long or quite short depending upon the diameter of wire that is used. The movement of the needle 11, as well as many other aspects of the coil-winding machine with which the mechanism of FIG. 1 is used, is controlled by a stored-program controller (not shown).

The preferred controller is designated by a manufacturer's model number 584 and is manufactured by the Modicon Divison (Andover, Mass.) of Gould, Inc.

Figure 7A:
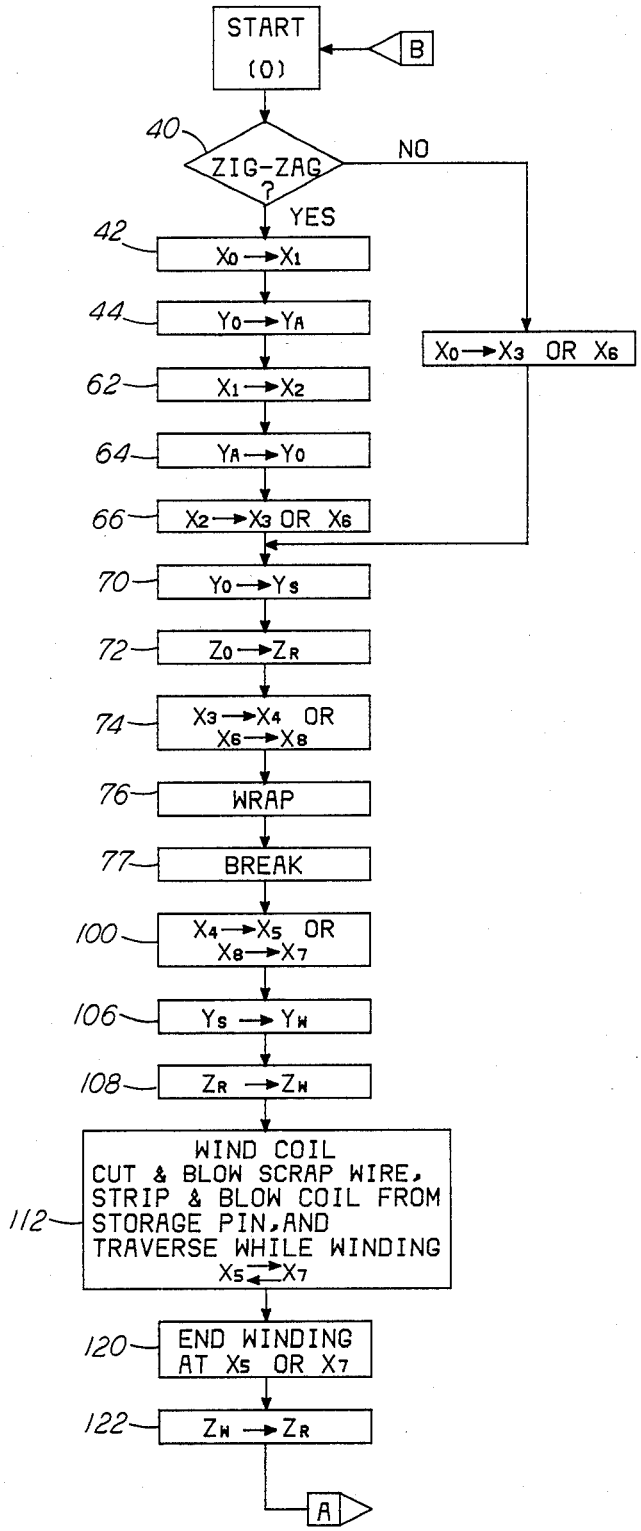
FIGS. 7A and 7B show a flow diagram illustrating a software program useful with a stored-program controller, for controlling the movement of a wire-guiding and dispensing needle, utilized in the practice of the present invention.
Figure 7B:
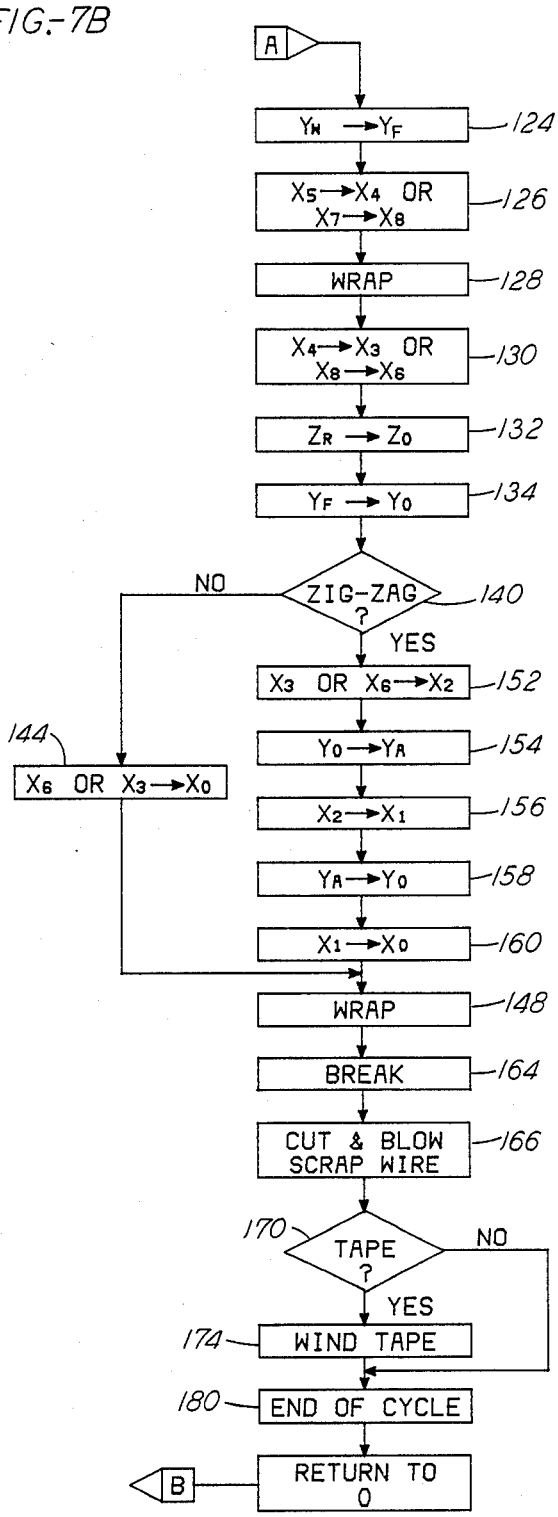

(Rolling Meadows, Ill.). However, any process controller of comparable capability can be adapted by one skilled in the art. The Controller is a real-time, stored-program controller having the capability of receiving and transmitting several thousand inputs and outputs. Given a flow diagram as illustrated in FIGS. 7A and 7B, the Gould Modicon model 584 controller can be programmed using relay logic symbols in order to permit an electrical tradesman with no programming experience to program the controller with relative ease in accordance with the instructions contained in the *Modicon* 584 *Programmable Controller User's Manual,* copyright 1980 by Gould, Inc., Modicon Divison. This 85-page user's manual is intended to instruct an electrical tradesman familiar with relay logic to a sufficient level to program the Gould Modicon model 584 controller in accordance with flow chart instructions. Therefore, one skilled in the art can readily program the Gould Modicon model 584 controller from the flow chart of FIGS. 7A and 7B in order to control the stepping motors and other driving devices to operate the various components described herein that differ from or are in addition to the coil-winding machine of the above-mentioned Parham et al. patent.

In practice, the operator who sets up the coil-winding machine to wind coil bobbins will manually enter into the winding machine's inputs the requisite indications of the coil to be wound. One of these inputs is a switch position (YES or NO) which controls whether or not the needle follows a ZIG-ZAG path. The stored-program controller that operates the machine adjusts the path 20 according to the manual ZIG-ZAG input. With wire diameters of 40-gauge or smaller, the set-up operator sets the ZIG-ZAG switch (not shown) to its YES position, in order to direct a more serpentine path 20.

Referring now to FIGS. 1, 7A, and 7B, at the start of a winding cycle of operation of the mechanism of FIG. 1, the stored-program controller (not shown) queries the ZIG-ZAG switch (also not shown). If the wire diameter is larger than 40 gauge, the ZIG-ZAG switch has been set to NO, causing the controller to direct the wire 10 by moving the needle 11 in a more direct path. This decision point in the portion of the program depicted in FIG. 7A is represented by the ZIG-ZAG decision indicated in a diamond-shaped block or step 40. If the wire diameter is equal to or smaller than 40 gauge, the ZIG-ZAG switch has been set to YES; and the program proceeds to the next block in FIG. 7A that represents a program step 42.

In the step 42 of FIG. 7A, the controller causes the X stepping motor to move the needle 11 to the left in the direction of the dotted line or path 20, from the Xo point as previously defined, from above the storage pin 12, to a point $X_1$. At this point, the X motor stops and the program of FIG. 7A proceeds to the next step 44, at which the controller causes the Y motor to operate in order to advance the needle 11 in the Y direction along the dotted line or path 20 until the controller determines that the needle 11 has reached the $Y_A$ position.

It will be apparent from FIG. 1 that, as the needle 11 moves from the (Xo, Yo, Zo) position to the ($X_1$, Yo, Zo) position, to the ($X_1$, $Y_A$, Zo) position, the needle is moving around a routing pin 50. Thus, the needle 11 is routing an intermediate portion of the wire 10 about the routing 50 but generally toward a terminal pin 14. Besides routing the wire 10 from the storage pin 12 to one of the terminal pins 14, the routing pin 50 and two other routing pins 52 and 54 are also used at least partly to control the tension or tensile stress in the various portions of the wire when the wire is later intentionally broken. That control of the tensile stress during wire breakage is at least in part accomplished by using the friction of the wire 10 wrapped part way around the routing pins 50, 52, and 54. The friction between the wire 10 and the routing pins 50, 52, and 54 serves to decouple breaking tension within the wire. Absent such friction, tension introduced into the wire would be present over all portions of a length of wire extending from a trailing portion attached to the storage pin to a leading portion which is the portion of the wire nearest the terminal pins 14. With the friction decoupling, a tensile stress introduced into the portion of the wire 10 nearest a terminal pin 14 is partly resisted at each routing pin 50, 52, and 54 that the wire touches. Therefore, the tensile stress is less in the portion of the wire 10 nearest the storage pin 12. The routing pin 54 also keeps intermediate portions of the wire 10 away from the terminal pins 14 in the row 14B when the wire extends from the storage pin 12 to a terminal pin 14 in the row 14A.

Figure 5:
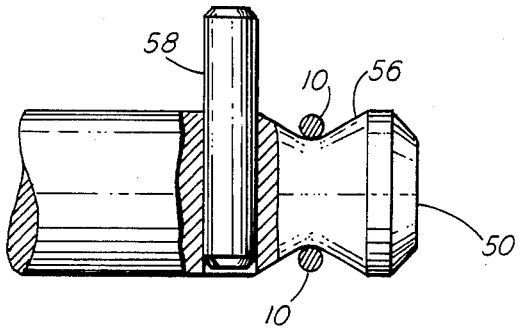
FIG. 5 is a detailed view, partly in cross-section, of a routing and tension-controlling pin.

Referring now to FIG. 5, there is shown, partially in section, a fragmentary, enlarged view of the routing pin 50. All three routing pins 50, 52, and 54 (FIG. 1) are fixedly mounted on the coil-winder frame or structure (not shown). The routing pins 50, 52, and 54 are made from steel pins and have cut-down annular grooves 56 where the wire 10 can rest. Each routing pin 50, 52, and 54 has a radially-extending blocking pin 58 which keeps the wire from flopping back beyond the groove 56.

As illustrated in FIG. 5, the intermediate portion of wire 10 can rest in either the top or the bottom of the groove 56 of the routing pin 50, depending upon whether the wire is dressed over or under the routing pin.

When the needle 11 reaches the ($X_1$, $Y_A$, Zo) position along the dotted line or path 20 (FIG. 1), the controller advances to the next program step 62 (FIG. 7A). The Y stepping motor is turned off with the needle 11 in the $Y_A$ position, and the X stepping motor is operated to move the needle in the dotted path 20 from the $X_1$ to the $X_2$ position. When the controller advances to the next program step 64, it causes the Y motor to operate so as to advance the needle 11 from the $Y_A$ position back to the Yo position along the path 20.

Although the needle 11 moves in the rectangular path 20, the wire 10 is always under a slight tension as it is drawn through or dispensed from the needle. Therefore, the wire 10 will actually assume the route or configuration that is designated by the reference number 10 in FIG. 1. To the right of the routing pin 50, the configuration of the wire 10 is shown bifurcated to the two storage pins 12A and 12B to illustrate the fact that two wires are dispensed from two needles 11. These trailing portions of the wires 10 are dispensed by the needles 11 as the needles move from above the two storage pins 12A and 12B to follow the path 20 around the routing pin 50. To the left of the routing pin 52, the configuration of the two wires 10 is shown bifurcated to form two leading portions of the two wires to the two rows 14A and 14B of terminal pins 14, to illustrate the alternative configuration that the leading portions of the wires can take.

When the controller determines that the needle 11 has reached the ($X_2$, Yo, Zo) position, the program of FIG. 7A advances to program step 66, at which the controller causes the X motor to move the needle from the $X_2$ position to either the $X_3$ position or the $X_6$ position. The positions $X_3$ and $X_6$ are just beyond the routing pins 52 and 54, respectively.

The choice between the $X_3$ position or the $X_6$ position is determined by the programming that has been given to the controller at one of its many inputs, by reason of a manual input during machine setup by the setup operator. If the machine is to wrap the wire 10 around one of the terminal pins 14 of the row 14B, the setup operator sets this fact into the program by a manual input. The controller then stops the advance of the X motor and the needle 11 at the $X_3$ position. However, the controller continues to advance the needle 11 in the X direction to the $X_6$ position if the wire 10 is to be wrapped around one of the terminal pins 14 of the row 14A of the bobbin 16.

Referring again to the ZIG-ZAG decision step 40 in FIG. 7A, had the diameter of the wire been larger than 40 gauge, the ZIG-ZAG decision would have been NO; and the steps 42, 44, 62, 64, and 66 would have been omitted. The controller would then branch to an alternative step 68 which causes the X stepping motor to advance the needle 11 all the way from the Xo position to either the $X_3$ or the $X_6$ position, without any intervening Y movement at all.

When the needle 11 reaches Yo position and the $X_3$ or the $X_6$ position, whether after the program step 66 or the step 68 of FIG. 7A, the controller operates the Y motor in order to move the needle 11, in accordance with a step 70, from the Yo position to the $Y_S$ position. This movement of the needle 11 from the Yo position to the $Y_S$ position is to dispense the wire 10 from the routing pin 52 or 54 more directly toward the row 14B or 14A, respectively, of terminal pins 14. The $Y_S$ position is the Y position of the needle 11 when the needle is above the terminal pin 14 around which the wire 10 is to be wrapped. The designation $Y_S$ indicates the Y position of the needle 11 for wrapping the wire 10 around a terminal pin 14 prior to or at the start of the operation of winding the wire around the square central tube 32 of the bobbin 16.

With the bobbin 16 illustrated in FIGS. 1 and 3, $Y_S$ can be any one of six different Y positions indicated by the range of Y positions marked $Y_S$ and $Y_F$. The designation $Y_F$ indicates the Y position of the needle 11 when it is about to wrap the wire 10 around a terminal pin 14 after the finish of the winding of wire around the square central tube 32 of the bobbin 16. Preferrably, the six $Y_F$ positions are the same as the six $Y_S$ positions.

As soon as the program step 70 of FIG. 7A has been completed and the needle 11 is at a Y position (the $Y_S$ position) above the desired one of the terminal pins 14, the program advances to the next step 72, at which point the controller is programmed to cause the Z motor to move the needle toward the arbor 18 and the bobbin 16 or away from them according to the size of the specific bobbin that is being wound. The Z motor stops at such time as the needle 11 is in the $Z_R$ (for wrap) position. The Z motion of the needle 11 is in the direction perpendicular to the plane of FIG. 1, as illustrated by the axis system 30.

The controller then advances to the next program step 74 at which the controller operates the X motor to move the needle 11 to the left in FIG. 1 from the $X_3$ position to the $X_4$ position or from the $X_6$ position to the $X_8$ position, directly above the selected one of the terminal pins 14. This position, ($X_4$ or $X_8$, $Y_S$, $Z_R$), is the needle position at the start of the wrap operation. While the wrapping of the wire 10 is shown in FIG. 1 as being counterclockwise starting from above the terminal pin 14 about which it is wrapped, wrapping could just as well be in the clockwise direction or start from below the pin.

At this point, the controller advances to the next step 76 and sends a wrap signal to a wrap mechanism such as that disclosed in the abovementioned U.S. Pat. No. 4,320,876 to Parham et al. Alternatively, the controller can easily be programmed to operate the X and Y motors in such a way that the needle 11 orbits around the terminal pin 14. An analog equivalent of such a motion is the circular Lissajous figure on the screen of an oscilloscope when the horizontal and vertical deflection electrodes receive suitably-phased sinusoidal signals of the same amplitude. Of course, to wrap the wire 10 around the terminal pin 14, some simultaneous Z motion may be necessary to accommodate the thickness of each turn of the wire on the terminal pin.

After the conclusion of the wrap operation, the leading portion of the wire 10 has been tightly wrapped around the selected terminal pin 14 by the action of the needle 11 orbiting the terminal pin. At this point, the controller advances to a break step 77. If the wire 10 had been wrapped around one of the terminal pins 14 of the row 14B, the controller sends a command to cause a breaker bar 78, having a freely-rotatable breaker pin 80, to descend. If the wire 10 had been wrapped around one of the terminal pins 14 of the row 14A, the controller causes a breaker bar 82 with a rotatable breaker pin 84 to descend. When the breaker pin 80 or 84 engages the wire 10, it flexes the wire and adds tension in the wire, until the wire breaks from the tensile stress thus induced into the wire, hopefully breaking in tension at a corner of the terminal pin 14.

Figure 6:
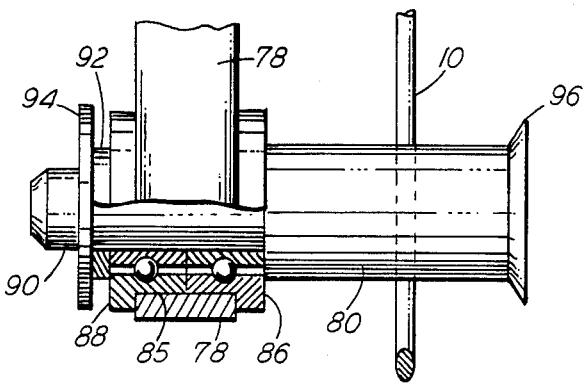
FIG. 6 is a detailed view, partly in cross-section, showing the bearing mounting of a breaker pin to permit the free rotation thereof in accordance with another aspect of the present invention.

The breaker bar 78 and breaker pin 80 are shown in FIG. 6, partially in cross-section and in greater detail. The breaker bar 78 has a hole 85 in its bottom end. Two miniature ball bearings 86 and 88 are mounted in the hole. The breaker pin 80 has a reduced-diameter portion 90 that extends through the inner races of the two ball bearings 86 and 88. A washer 92 and a retaining ring 94 serve to hold the breaker pin 80 in such a way as to keep the bearings 86 and 88 tightly positioned within the breaker bar 78. A flange 96 at the outer end of the breaker pin 80 tends to keep the wire 10 from slipping off the end of the breaker pin.

The breaker pin 80, being freely rotatable by reason of the bearings 86 and 88, applies tension to the wire 10 equally in both directions as the breaker bar 78 descends. Any frictional tendency of the breaker pin 80 to drag the wire 10 down toward the bobbin 16 and thus pull harder on the portion of the wire to the right of the breaker pin, as viewed in FIG. 1, is immediately neutralized by the free rotation of the breaker pin.

When the breaker pin 80 has moved down far enough, it breaks the wire 10 in tension. Since the wire 10 is wrapped in the counterclockwise direction around the square terminal pin 14 in the row 14B, the wire will have its greatest tendency to break at the upper, left-hand corner of the terminal pin since the surface of the wire will have been nicked or damaged by reason of being wrapped around the square terminal pin.

Since the wire 10 rests in the groove 56 of the routing pin 52 and perhaps at the bottom of the groove of the routing pin 50, the friction at the routing pin 52 and perhaps at the routing pin 50 tends to oppose and resist some of the tension produced in the wire to the right of the breaker pin 80 in FIG. 1. Therefore, the tension induced by the breaker pin 80 in the wire 10 is thus reduced or partially decoupled and is substantially less at the storage pin 12 than the tension in the wire at the terminal pin 14. Consequently, the wire 10 will break at the terminal pin 14 and not at a distant point such as the storage pin 12.

If the wire 10 had been wound onto one of the terminal pins 14 of the row 14A, the controller would command the descent of the breaker bar 82 with the breaker pin 84 instead of the breaker bar 78 with the breaker pin 80. Also, the frictional force, that at least partially decouples the wire tension from the storage pin 12, occurs at the routing pin 54 and perhaps at the routing pins 50 and 52. Breaking the wire at the terminal pin 14 leaves a length of wire wrapped around the storage pin 12 and extending from the storage pin, about one or more of the routing pins 50, 52, and 54 and to the broken end of the wire, where the length of wire broke at the terminal pin 14.

After the wire has been broken at the terminal pin 14 in the break step 77 of FIG. 7A, the controller advances to the next program step 100 at which the X motor is commanded to advance the needle 11 from either the $X_4$ position over one of the terminal pins 14 of the row 14B or the $X_8$ position over one of the terminal pins 14 of the row 14A to the nearest end of the square central tube 32 (see FIGS. 1 and 3) of the bobbin 16, designated as either the $X_5$ position (rightmost, in FIG. 1) or the $X_7$ position (leftmost, in FIG. 1), respectively.

Over many years of coil winding, various manufacturers have identified desirable positions for the final guiding of the wire prior to winding the wire onto a bobbin. However, within a range, the exact final guiding position is not particularly critical. At the next program step 106 of FIG. 7A, the needle 11 is moved in the Y direction from the Y position (designated $Y_S$) above the wrapped terminal pin 14 to the Y position (designated Yw in FIGS. 7A and 7B; but since Yw is arbitrary, it is shown very flexibly in FIG. 1) at which winding is to take place. When the needle 11 has reached the $Y_W$ position, the program advances to the next step 108 of FIG. 7A. At the step 108, the controller causes the needle 11 to move from the $Z_R$ or wrapping position to the $Z_W$ or winding position. As with Yw, the exact position of Zw is arbitrary and may vary from manufacturer to manufacturer. Therefore, the position Zw has been shown only vaguely in FIG. 1, although referred to extensively in FIGS. 7A and 7B.

When the needle 11 has been fully positioned at the ($X_5$ or $X_7$, $Y_W$ and $Z_W$) position at an end of the square central tube 32 for winding, the coil-winding machine goes into its winding mode as described in the above-mentioned patent to Parham et al. During the coil-winding operation, the controller causes the needle 11 to move from end-to-end of the square central tube 32 of the bobbin 16 (between $X_5$ and $X_7$) repeatedly at an approximate rate determined by the winding speed of the arbor and the diameter of the wire being wound.

Simultaneously, the controller directs the operation of a cutter blade 116 (FIG. 1) which descends and cooperates with a stationary, sharp, mating anvil 118, acting much like a pair of scissors, to shear the wire 10 between the storage pin 12 and the routing pin 50 in order to separate the length of broken wire 10 to the left of the cutter 116 (FIG. 1) from the coil of wire wrapped around the storage pin 12. After the wire 10 has been cut, an air blast blows the resulting broken and cut piece of wire extending to the left of the cutter 116 away from the winding area. The portion of the wire 10 that has been wrapped around the storage pin 12 is also stripped from the storage pin and blown away. The purpose of the cutter 116 and the anvil 118 is to separate the two portions of the length of scrap wire 10 to minimize the risk of entangling the scrap wire during the ejection process, it being less likely that two shorter pieces will entangle, than one long piece.

When coil winding is being completed, the program advances to a step 120 which causes the needle 11 to be positioned at one or the other end ($X_5$ or $X_7$) of the square central tube 32 of the bobbin 16 when the bobbin comes to a halt. The program then advances to the next program step 122 at which the controller operates the Z motor to move the needle 11 from the $Z_W$ position to the $Z_R$ position. Referring now to FIG. 7B, the controller then advances to a step 124, at which point the controller operates the Y motor to move the needle 11 from the $Y_W$ position to the $Y_F$ position which is the finish wrapping position above one of the terminal pins 14. The range of $Y_F$ positions is identical to the range of $Y_S$ positions. The controller then advances the program to a step 126 at which the needle 11 is moved either from the $X_5$ position to the $X_4$ position or from the $X_7$ position to the $X_8$ position in anticipation of wrapping the wire 10 around a terminal pin 14.

The controller then advances to a wrapping step 128 at which, as in the case of the wrapping step 76, the controller directs the operation of the wire-wrapping mechanism of the above-mentioned Parham et al. patent to wrap the wire 10 around the selected terminal pin 14.

After the wire 10 has been wrapped around the terminal pin 14, the controller advances to the next program step 130 at which the needle 11 is moved to the right either from the $X_8$ position to the $X_6$ position or from the $X_4$ position to the $X_3$ position in order to allow later ascent of the needle to the Yo position without interference with the terminal pins 14. When the controller reaches a step 132, it operates the Z motor to move the needle 11 from the $Z_R$ wrapping position back to the Zo position, according to the axis system 30. The program then advances to a step 134 at which the Y motor operates to move the needle 11 from the $Y_F$ position up to the Yo position.

The program then advances to a ZIG-ZAG decision step 140 which is comparable to the ZIG-ZAG decision step 40 of FIG. 7A. In the ZIG-ZAG decision step 140 of FIG. 7B, if the diameter of the wire 10 is larger than 40-gauge, the answer to the ZIG-ZAG decision step 140 is NO. The program then branches to a step 144 at which the controller causes the X motor to step the needle 11 to the right in FIG. 1 from either the $X_6$ or the $X_3$ position directly to the Xo position. The program then advances to a wrap step 148.

However, if the ZIG-ZAG decision step 140 recognizes that the ZIG-ZAG switch (not shown) is in the YES state, the program proceeds to a step 152 which causes the controller to advance the needle 11 from either the $X_3$ position or the $X_6$ position only to the $X_2$ position in order to allow the needle to be guided around the bottom of the routing pin 50. Once the needle 11 is at the $X_2$ position, the program advances to a step 154 which causes the controller to drive the Y motor to move the needle from the Yo position to the $Y_A$ position. At a step 156, the controller operates the X motor to move the needle 11 from the $X_2$ position to the $X_1$ position. A step 158 then causes the controller to operate the Y motor again to move the needle 11 from the $Y_A$ position to the Yo position. A step 160 causes the controller to operate the X motor to move the needle 11 from the $X_1$ position to the Xo position, which puts the needle over the storage pin 12. After the step 160, the program of FIG. 7B advances to a wrap step 148.

Whether the program control came from the branch through the step 144 or directly through the step 160, when the program advances to the wrap step 148 in FIG. 7B, the controller operates the wire-wrapping mechanism of the coil-winding machine so as to wrap the wire 10 around the storage pin 12.

Once the wire 10 has been wrapped around the storage pin 12, the program advances to a step 164 which causes either the breaker bar 78 or the breaker bar 82 to descend so that the breaker pin 80 or the breaker pin 84 can break the wire at the terminal pin 14. This leaves another length of wire extending from the broken end that was broken from the terminal pin 14, about one or more of the routing pins 50, 52, and 54 and wrapped around the storage pin 12, but also extending to the needle 11.

After the wire 10 has been broken at the terminal pin 14, the program advances to a step 166 at which the controller operates the cutter blade 116 to cut the portion of the length of wire between the routing pin 50 and the storage pin 12. At the step 166, the controller also operates the air source (not shown) which blows away the portion of the length of wire extending between the cut and the broken end at which the length of wire was broken from the terminal pin 14. At this point, the wire 10 remains wrapped around the storage pin 12 and then extends to the needle 11 positioned at the (Xo, Yo, Zo) position right above the storage pin 12 and ready to start a new cycle of operation.

As part of the manual set-up of the coil-winding machine, the set-up operator instructs the machine by manual inputs whether a length of adhesive tape (not shown) is to be applied to selected windings on the bobbin 16. After the cut-and-blow step 166, the program advances to a tape decision step 170, at which point the controller determines if a length tape is to be wound onto the bobbin 16 after the most recent winding of wire 10. If the answer is YES, the program advances to a wind step 174 which causes the controller to operate the tape-winding mechanism of the abovementioned Parham et al. patent. If the tape decision step 170 is answered in the negative, the tape decision branches to a NO point which bypasses the wind step 174.

Whether the program proceeds from the NO answer at the tape decision step 170 or after the wind step 174, the program then proceeds to an end-of-cycle step 180 from which the controller can determine whether it is to eject a completed bobbin 16 and proceed to load a new blank bobbin and start a new cycle or simply return to the start of the program of FIGS. 7A and 7B to wind another coil onto the bobbin.

What is claimed is:

1. An apparatus for routing and controlling the tension in a wire extending from a distant point to a terminal pin on a bobbin, which comprises:

means for securing a trailing portion of the wire to hold the trailing portion at the distant point while leading portions of the wire are being routed toward the terminal pin;

first routing and tension-controlling means, stationary with respect to the securing means, for decoupling from one portion of the wire at least a portion of a tensile stress applied to another portion of the wire and for routing a first intermediate portion of the wire in a direction generally toward the terminal pin;

second routing and tension-controlling means, stationary with respect to the securing means, for decoupling from said one portion of the wire at least another portion of a tensile stress applied to said other portion of the wire and for routing a second intermediate portion of the wire directly toward the terminal pin; and means for dispensing the trailing portion of the wire about the securing means for attachment thereto, the intermediate portions of the wire about at least portions of the first and second routing and tension-controlling means and a leading portion of the wire to a position adjacent and about the terminal pin for attachment thereto, whereby the first and second routing and tension-controlling means share in resisting the tensile stress in the wire between the securing means and the terminal pin.

2. An apparatus for routing a wire to a row of terminal pins on a bobbin mounted in a coil-winding machine and for controlling the tension in the wire, said apparatus comprising:

a storage pin for securing a trailing portion of the wire to hold the trailing portion while intermediate and leading portions of the wire are being routed toward the row of terminal pins;

a first routing and tension-controlling pin nearest the storage pin, and stationary with respect thereto, for routing the wire on either side of the first routing and tension-controlling pin and generally toward the tow of terminal pins and for assisting in controlling the tensile stress in the wire;

a second routing and tension-controlling pin stationary with respect to the storage pin and spaced from the first routing and tension-controlling pin and generally between the first routing and tension-controlling pin and the row of terminal pins for routing the wire directly toward the tow of terminal pins and for assisting in controlling the tensile stress in the wire; and means for dispensing the trailing portion of the wire about the storage pin for attachment thereto, intermediate portions of the wire about at least portions of the first and second routing and tension-controlling pins, and a leading portion of the wire to a position adjacent and about one terminal pin of the row of terminal pins to attach the leading portion of the wire to the terminal pin, whereby the first and second routing and tension-controlling pins share in resisting a tensile stress induced into the wire between the storage pin and the row of terminal pins.

3. An apparatus according to claim 2 wherein the row of terminal pins is a first row at a first location and the bobbin has a second row of terminal pins located at a second location, said second location being on the side of the first location opposite from the storage pin and wherein the apparatus further comprises a third routing and tension-controlling pin spaced from the second routing and tension-controlling pin and generally between the second routing and tension-controlling pin and the second row of terminal pins, wherein the dispensing means comprises means for routing the wire over the third routing and tension-controlling pin and directly toward the second row of terminal pins for attachment to a terminal pin thereof, said third routing and tension-controlling pin assisting in controlling the tensile stress in the wire.

4. An apparatus according to claim 3 further comprising:

a first means located generally between the second routing and tension-controlling pin and the first row of terminal pins for selectively inducing a tensile stress in a first extending portion of the wire which extends between the portion of the wire attached to one terminal pin of the first row of terminal pins and the portion of the wire attached to the storage pin, and for breaking the first extending portion of the wire in tension adjacent the one terminal pin of the first row of terminal pins; and a second means located generally between the third routing and tension-controlling pin and the second row of terminal pins for selectively inducing a tensile stress in a second extending portion of the wire which extends between the portion of the wire attached to one terminal pin of the second row of terminal pins and the portion of the wire attached to the storage pin, and for breaking the second extending portion of the wire in tension adjacent the one terminal pin of the second row of terminal pins.

5. An apparatus according to claim 4 further comprising:

means located generally between the storage pin and the first routing and tension-controlling pin for cutting into two pieces the first or second extending portions of wire; and means for ejecting at least one of the two pieces of wire.

6. An apparatus according to claim 4 wherein the first and second tensile-stress-inducing and breaking means each comprises a freely-rotatable breaker pin adapted to move generally through the path of the wire to deflect the wire to the point of breakage.

7. An apparatus according to claim 2 further comprising: means located generally between the second routing and tension-controlling pin and the row of terminal pins for selectively inducing a tensile stress in an extending portion of the wire which extends between the portion of the wire attached to one terminal pin of the row of terminal pins and the portion of the wire attached to the storage pin, and for breaking the extending portion of the wire in tension adjacent the one terminal pin of the row of terminal pins.

8. An apparatus according to claim 7 wherein said tensile-stress-inducing and breaking means comprises a freely-rotatable breaker pin adapted to move generally through the path of the wire to deflect the wire to the point of breakage.

9. An apparatus according to claim 7, further comprising:

means located generally between the storage pin and the first routing and tension-controlling pin for cutting into two pieces the extending portion of wire; and means for ejecting at least one of the broken two pieces of wire.

10. An apparatus for breaking a wire extending in a path from a storage pin to one of a plurality of terminal pins of a row of terminal pins on a coil bobbin, comprising:

a breaker pin located generally between the row of terminal pins and the storage pin;

means for moving the breaker pin generally through the path of the wire at least far enough to deflect the wire sufficiently to induce in the wire a tensile force sufficient to break the wire in tension; and at least one routing and tension-controlling pin, relatively-movable with respect to the breaker pin and located generally between the storage pin and the breaker pin and over which the wire is routed, on the side of the routing and tension-controlling pin opposite from the direction to which the wire is to be deflected.

11. An apparatus according to claim 10 wherein the breaker pin is freely rotatable.

12. An apparatus according to claim 10, further comprising:

means located generally between the storage pin and the routing and tension-controlling pin for cutting into two pieces the portion of wire extending from the storage pin to the broken end of that portion of the wire; and means for ejecting the two pieces.

13. An apparatus for breaking a wire extending in a path from a storage pin to one of the terminal pins of a row of terminal pins on a coil bobbin, comprising:

a freely-rotatable breaker pin located generally between the row of terminal pins and the storage pin;

means for moving the breaker pin generally through the path of the wire at least far enough to deflect the wire to the point of breakage in tension; and means stationary with respect to the storage pin for decoupling at least a portion of the tension in the wire from the storage pin.

* * * * *